United States Patent [19]

Renger

[11] Patent Number: 4,475,868

[45] Date of Patent: Oct. 9, 1984

[54] FREE-FLOW-PUMP

[75] Inventor: Hagen Renger, Lignières, Switzerland

[73] Assignee: Emile Egger & Cie SA, Cressier, Switzerland

[21] Appl. No.: 445,971

[22] Filed: Dec. 1, 1982

[30] Foreign Application Priority Data

Dec. 8, 1981 [CH] Switzerland ..... 7825/81

[51] Int. Cl.[3] ..... F04D 29/44

[52] U.S. Cl. ..... 415/213 A; 415/109; 415/209; 415/219 A; 415/219 C; 415/206

[58] Field of Search ..... 415/206, 109, 198.1, 415/219 R, 207, 199.1, 219 B, 213 A, 209, DIG. 3, 219 A

[56] References Cited

U.S. PATENT DOCUMENTS

| | | | |
|---|---|---|---|
| 3,171,357 | 3/1965 | Egger | 415/206 |
| 3,542,496 | 11/1970 | Bergeson | 415/206 |
| 3,547,554 | 12/1970 | Willette | 415/206 |
| 3,741,679 | 6/1973 | Johnston | 415/53 |
| 3,918,829 | 11/1975 | Korzec | 415/207 |
| 4,213,742 | 7/1980 | Henshaw | 415/206 |
| 4,307,995 | 12/1981 | Catterfeld | 415/206 |

FOREIGN PATENT DOCUMENTS

| | | | |
|---|---|---|---|
| 1046502 | 12/1958 | Fed. Rep. of Germany | 415/213 A |
| 1528684 | 1/1970 | Fed. Rep. of Germany . | |
| 2048087 | 5/1971 | Fed. Rep. of Germany | 415/213 |
| 2413571 | 8/1979 | France | 415/206 |
| 2057567 | 4/1981 | United Kingdom | 415/206 |

*Primary Examiner*—Samuel Scott
*Assistant Examiner*—Brian J. Bowman
*Attorney, Agent, or Firm*—Wender, Murase & White

[57] ABSTRACT

The free-flow pump has an impeller housing (9, 10) laterally of its free flow chamber (4), and the impeller (6) is located in the impeller chamber (9, 10). The external, radial limiting member (10) of the impeller housing is drawn forwardly into the free flow chamber so as to decrease in the direction of rotation from the housing tongue (11) to the pressure pipe outlet. The limiting member (10) causes a constriction in the external portion (4') of the flow chamber, and such constriction decreases from the housing tongue towards the pressure pipe outlet. These measures permit the pump characteristics to be improved, and in particular the throttle characteristic of the free-flow pump can be stabilized.

7 Claims, 12 Drawing Figures

FREE-FLOW-PUMP

BACKGROUND OF THE INVENTION

The present invention relates to a free-flow pump, wherein a free flow chamber permitting free passage between suction and pressure pipes is located in the housing of the pump laterally of the impeller which is disposed in an impeller chamber, the greatest diameter of the free flow chamber exceeding the diameter of the impeller chamber. Known pumps of this type (US Pat. No. 3,171,357) generally exhibit a disadvantageous throttle curve, particularly when they have a relatively large, free passage, i.e. when the following condition is met:

$$\frac{\text{diameter of the largest deliverable ball}}{\text{impeller diameter}} > 0.4$$

The disadvantageous throttle curve is caused by malfunctions during partial load in the region of the housing tongue, and such malfunctions affect the impeller flow. The use of smaller impeller outlet angles may in fact stabilize the throttle curve to some extent, but losses in head and in efficiency cannot be prevented owing to the reduced vane loading associated with smaller impeller outlet angles.

SUMMARY OF THE INVENTION

The present invention seeks to provide free-flow pumps of the above-mentioned type which have a more stable throttle curve without incurring losses in head and efficiency. This object is achieved in that an external limiting member defining the impeller chamber is drawn forwardly into the free flow chamber between the housing tongue and the pressure pipe outlet at least in one region so as to decrease in the direction of rotation.

This novel shape for the housing enables excess fluid which emerges from the pressure pipe during partial load, to be largely guided in the external region of the housing and, in consequence, to be kept remote from the impeller. The influences which cause instability of the throttle curve and losses in head and efficiency can therefore be eliminated. It also becomes possible, therefore, to provide the impeller with relatively large vane angles, thereby achieving particularly good levels of efficiency. In addition to the throttle curve being stabilized, improvements in the head can also be achieved when the slide valve is closed, and improvements in efficiency in the partial load range can also be achieved.

German Offenlegungsschrift No. 1 528 684 discloses covering only part of the circumference of the impeller by reducing the axial depth of the impeller chamber towards the pump outlet. The purpose of this measure is to allow the fluid to flow through the impeller more freely, and higher pressures are expected thereof. In addition, adequate acceleration energy is thereby to be imparted to the admixtures in the region of the pump outlet. The effects desired here and the measures taken are not comparable with the object and solution of the invention.

The above-mentioned impeller chamber limiting member which is drawn forwardly according to the invention, may be formed by a solid housing member or, alternatively, by a rib which protrudes axially into the flow chamber, the axial height of said rib decreasing in the direction away from the tongue region.

The impeller chamber limiting member is preferably drawn forwardly into the free flow chamber at least in one region which communicates with the housing tongue, so as to decrease in the direction of rotation. Generally, however, the housing will be so constructed that the axial width of the portion of the free flow chamber located radially externally of the impeller chamber limiting member increases steadily or constantly from the tongue region to the pressure pipe outlet, this increase being, for example, at least approximately 55% of the housing width in the tongue region.

The axial width of the portion of the flow chamber located radially externally of the impeller chamber limiting member may preferably increase constantly by at least approximately 55% of the housing width in the tongue region.

As already mentioned, the stabilizing effect resulting from the specific construction of the housing allows for greater flexibility in the choice of overall shape for the pump, more especially in the choice of shape for the impeller. In a preferred use of the pump in a pump program, it therefore becomes possible to use identical impellers in housings of which the respective suction pipes have different nominal widths. In addition to the above-mentioned advantages concerning the pump characteristics, therefore, economic advantages can also be realized.

BRIEF DESCRIPTION OF THE DRAWINGS

The invention will now be explained more fully with reference to two embodiments illustrated in the drawings.

DESCRIPTION OF THE PREFERRED EMBODIMENTS

Figure 2:
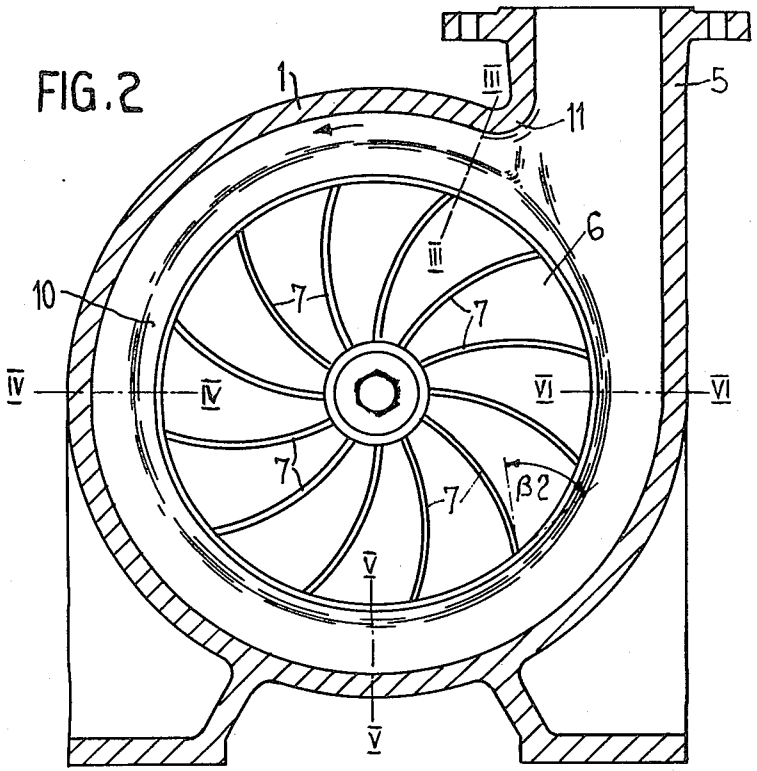
FIG. 2 is a radial section of the first embodiment.
Figure 1:
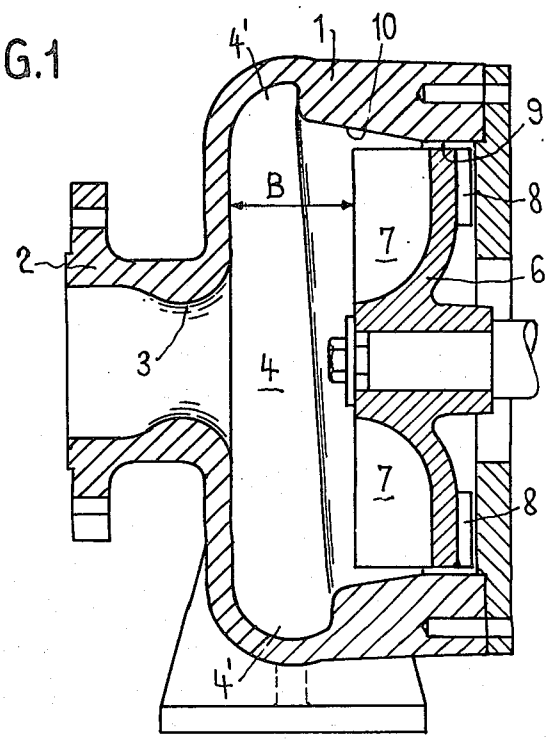
FIG. 1 is an axial section of the first embodiment.
Figure 6:
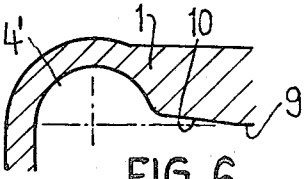
FIGS. 3 to 6 show the cross-sectional form of the internal wall of the housing in the sectional planes III to VI of FIG. 2.
Figure 5:
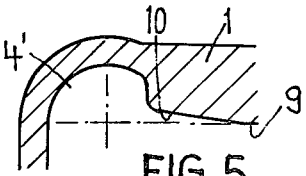
Figure 4:
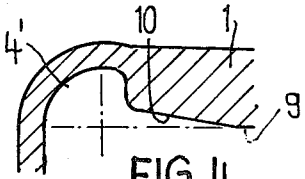
Figure 3:
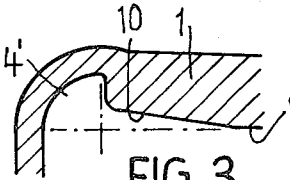
Figure 8:
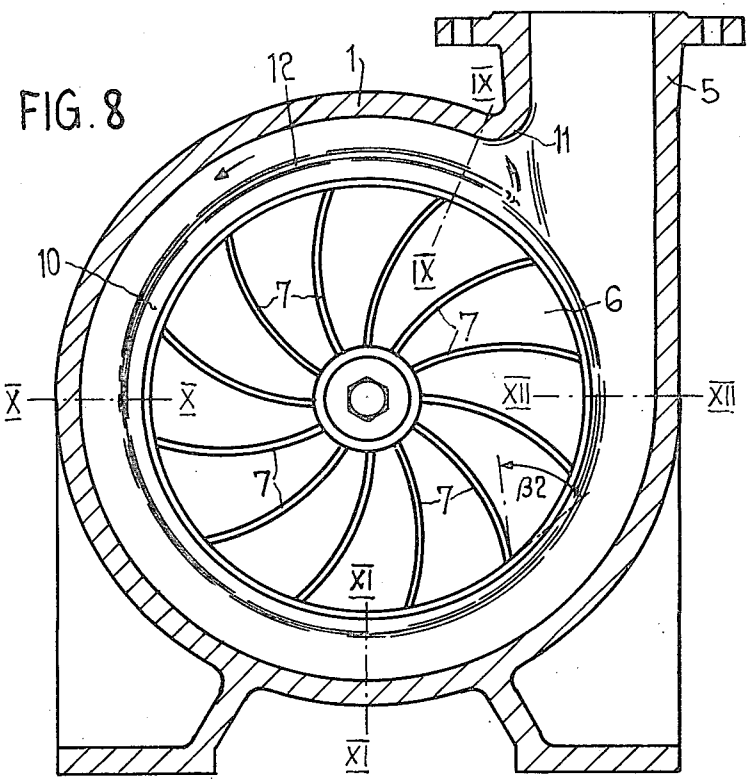
FIGS. 7 and 8 are axial and radial sections, respectively, of the second embodiment.
Figure 7:
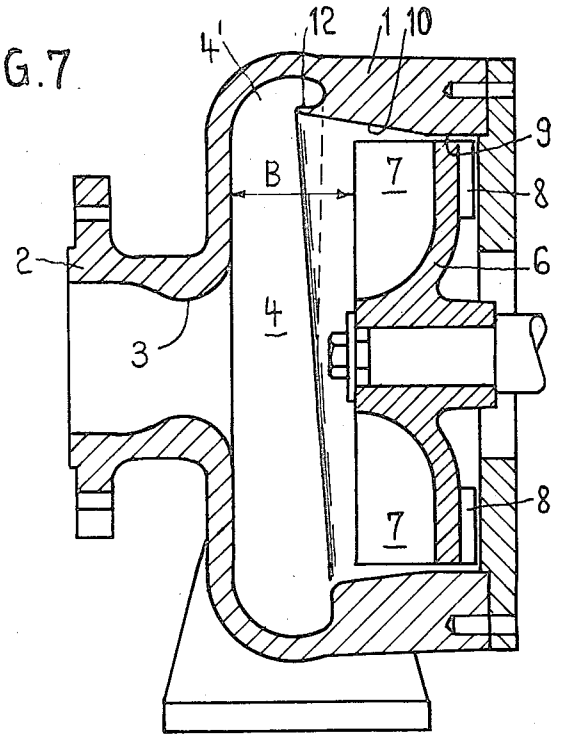
Figure 12:
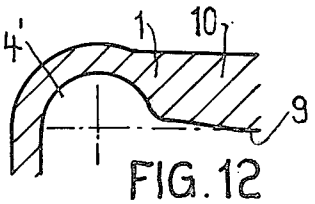
FIGS. 9 to 12 show the cross-sectional form of the internal wall of the housing of the second embodiment in planes IX to XII of FIG. 8.
Figure 11:
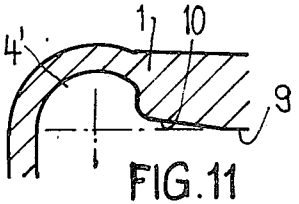
Figure 10:
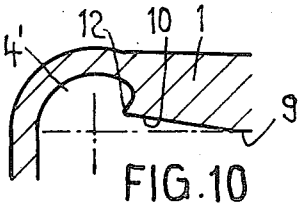
Figure 9:
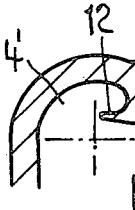

The pump housing 1 of FIGS. 1 and 2 has a suction pipe 2 with a constricted portion 3 at the inlet into the free flow chamber 4 of the pump and a tangentially arranged pressure pipe 5. The free-flow chamber 4 forms a free passage between the suction pipe and the pressure pipe such that a ball, which can enter through the suction pipe, can pass through the free-flow chamber to the pressure pipe 5 laterally of the impeller 6, which is provided with the vanes 7. Such free-flow pumps and their mode of operation are known per se and do not require any fuller explanation.

The impeller 6 is located in an impeller housing (also known as an impeller chamber), the radial limiting member of said impeller housing having a cylindrical region 9 in the region of the impeller disc and the rear vanes 8 and having a slightly truncated-cone-shaped region 10 in the region of the vanes or impeller channels. The particular structural feature of this impeller housing or the free-flow chamber resides in that the truncated-cone-shaped region of the external, radial impeller chamber limiting member is drawn forwardly into the flow chamber over the circumference of the housing to an uneven extent. As already illustrated in FIG. 1, the top of the region 10 of the impeller chamber limiting or defining member is drawn substantially further forwardly into the free flow chamber than the bottom. This structural shape is illustrated even more clearly in FIGS. 3 to 6 where the cross-sectional forms of the housing wall are shown in the four sectional planes III to VI of FIG. 2. This Figure shows that, in the sectional plane VI, the limiting member of the impeller housing is drawn forwardly into the free flow chamber, preferably in a constantly or steadily decreasing manner, from the housing tongue 11 in the direction of rotation of the impeller or of the flow to the pressure pipe outlet at sectional plane VI, this direction of rotation being indicated by an arrow in FIG. 2. Accordingly, an external portion 4' of the flow chamber remains radially externally of the impeller housing limiting member, and the axial width of said portion 4' preferably increases constantly or steadily from the housing tongue to the pressure pipe outlet. In such case, the width of the external portion 4' of the flow chamber in the tongue region may preferably be approximately 55% of the free housing width between the impeller and the opposite end wall of the housing.

As illustrated in FIG. 2, the impeller 6 has vanes 7 which are only slightly curved, so that a relatively large vane angle $\beta 2$ of approximately 60° is produced. As mentioned above, it is possible to select such relatively large vane angles of from 40° to 90°, thereby permitting an improvement in efficiency and head without the throttle curve having intolerable instability. This also applies to pumps having a relatively large free passage in accordance with the above mentioned condition. Because of the described shape of the housing, improvements in efficiency in the partial load range by approximately four points are achieved with optimum shape for the impeller and with a clearly improved throttle curve. In such case, it also becomes possible to use identical impellers for pumps having different nominal widths but the same diameter.

FIGS. 7 to 12 show the second embodiment of the pump, wherein corresponding parts have the same reference numerals as in FIGS. 1 and 2. The essential difference is that the forwardly drawn impeller housing limiting member is not formed on a solid housing member, but is formed on rib 12 which protrudes into the free flow chamber and decreases in the direction away from the tongue region. This produces an axially broader portion 4' of the flow chamber, more especially in the tongue region externally of this rib 12, thereby presenting certain additional advantages.

In the above-described embodiments which are illustrated in the drawing, the impeller limiting member which has been drawn forwardly into the free flow chamber is moulded on a integrally constructed pump housing. However, it would also be possible to insert a curved, wedgeshaped insert member into an otherwise rotationally symmetrical pump housing and thereby achieve the desired form of the impeller housing limiting member or the external portion of the free flow chamber. If desired, such an insert member could be formed by a suitably shaped sheet. It was assumed, in the foregoing, that the cross-sectional variation in the pump housing from the housing tongue to the pressure pipe outlet was substantially constant or steady. However, it would also be possible to effect a corresponding cross-sectional variation with an external limiting member of the impeller housing, which limiting member is drawn forwardly in decreasing manner, or with an increasing width of the external portion 4' of the flow chamber only in certain regions over a shorter portion of the circumference. In particular, this cross-sectional variation starting from the tongue region might only extend over a certain portion of the circumference, for example over 90° to 180°. In any event, the tongue region, in which the commencement of the forwardly drawn impeller limiting member or the constriction of the flow chamber begins, should be restricted to the first half of the first quadrant starting from the housing tongue, and should preferably be restricted to an angular range of approximately 150°. In other words, the commencement of the forwardly drawn portion of the impeller limiting member could be displaced by up to approximately 15° in the direction of rotation compared with that which is shown in the embodiments.

The illustrated impeller limiting member having a cylindrical portion 9 in the region of the impeller disc and having a slightly conical portion 10 in the region of the impeller channels, may be substituted by a different impeller limiting member, for example an impeller limiting member which is cylindrical or conical over the entire axial depth. Whereas, in the illustrated preferred embodiments, the impeller housing limiting member completely encloses the impeller, an embodiment would also be possible in which, for example in the region of the pressure pipe outlet, the impeller is not entirely covered, that is to say it is not covered on its entire axial width.

Having thus described the invention, what I claim as new and desire to be secured by Letter Patent is as follows:

1. An improved free-flow pump of the type having a pump housing defining a free-flow chamber having an axial dimension and a radial dimension, a suction pipe and a limiting member in communication with said free-flow chamber, said limiting member defining an impeller housing having a radial circumference less than that of said free-flow chamber, said impeller housing being laterally offset from and in communication with said free-flow chamber, said communication being established by said limiting member between said impeller housing and said free-flow chamber, said impeller housing having a rotatable vaned impeller, having a rotational direction, said vanes extending toward said axial dimension of said free-flow chamber, a pressure pipe disposed along and intersecting said radial circumference of said free-flow chamber, in communication with said free-flow chamber, and a housing tongue adjacent the intersection of said free-flow chamber with said pressure pipe, wherein the improvement comprises said limiting member extending into said free-flow chamber in said free-flow chamber axial dimension from a region occupied by said housing tongue and along said free-flow chamber radial dimension in said impeller rotational direction, said limiting member axial extension also decreasing in length of extension into said free-flow chamber in said impeller rotational direction.

2. The improvement according to claim 1, wherein said limiting member extends into said free-flow chamber in said free-flow chamber axial dimension at least adjacent said housing tongue and said limiting member axial extension decreases in length of extension into said free-flow chamber in said impeller rotational direction.

3. The improvement according to claims 1 or 2 wherein said free-flow chamber defines an external portion projecting radially outwardly from said limiting member, and said external portion steadily increases in length in the axial dimension of said free-flow chamber from the position of said housing tongue along said impeller rotational direction to said pressure pipe.

4. The improvement according to claim 1 wherein said limiting member is a rib which protrudes into said free-flow chamber in said free-flow chamber's axial dimension.

5. The improvement according to claim 1 wherein said limiting member completely surrounds said impeller in the axial dimension of said free-flow chamber.

6. The improvement according to claim 1 wherein said impeller vanes each define a vane angle of between approximately 40° and 90° and said free-flow chamber has a width in its axial dimension that is selected from a group of different widths adapted for creation of a family of pumps.

7. An improved free-flow pump of the type having a pump housing defining a free-flow chamber having an axial dimension and a radial dimension, a suction pipe and a limiting member in communication with said free-flow chamber, said limiting member defining an impeller housing having a radial circumference less than that of said free-flow chamber, said impeller housing being laterally offset from and in communication with said free-flow chamber, said communication being established by said limiting member between said impeller housing and said free-flow chamber, said free-flow chamber defining an external portion projecting radially outwardly from said limiting member, said impeller housing having a rotatable vaned impeller, having a rotational direction, said vanes extending toward said axial dimension of said free-flow chamber, a pressure pipe disposed along and intersecting said radial circumference of said free-flow chamber, and in communication with said free-flow chamber, and a housing tongue adjacent the intersection of said free-flow chamber with said pressure pipe, wherein the improvement comprises said limiting member extending into said free-flow chamber in said free-flow chamber axial dimension from a region occupied by said housing tongue and along said free-flow chamber radial dimension in said impeller rotational direction, said limiting member axial extension also decreasing in length of extension into said free-flow chamber in said impeller rotational direction, said external portion of said free-flow chamber increasing in length by at least 55% in the axial dimension of said free-flow chamber from a region occupied by said housing tongue along said impeller rotational direction.

* * * * *